US011808094B2

(12) United States Patent
Kumar et al.

(10) Patent No.: US 11,808,094 B2
(45) Date of Patent: Nov. 7, 2023

(54) FLEXI-STRING FOR WASHOUT BELOW A CASING SHOE

(71) Applicant: SAUDI ARABIAN OIL COMPANY, Dhahran (SA)

(72) Inventors: Sanjiv Kumar, Udhailiyah (SA); Muhammad Imran Javed, Abqaiq (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 50 days.

(21) Appl. No.: 17/466,468

(22) Filed: Sep. 3, 2021

(65) Prior Publication Data

US 2023/0070661 A1 Mar. 9, 2023

(51) Int. Cl.
*E21B 17/10* (2006.01)
*E21B 17/14* (2006.01)

(52) U.S. Cl.
CPC ..... *E21B 17/1078* (2013.01); *E21B 17/14* (2013.01)

(58) Field of Classification Search
CPC .... E21B 17/14; E21B 17/1078; E21B 33/134; E21B 33/138; E21B 21/003
See application file for complete search history.

(56) References Cited

U.S. PATENT DOCUMENTS 3,289,761 A * 12/1966 Smith ..... E21B 33/134 166/290
5,743,335 A 4/1998 Bussear
9,169,724 B2 10/2015 Fripp et al.
2016/0160106 A1* 6/2016 Jamison ..... C09K 8/035 507/112
2018/0087350 A1* 3/2018 Sherman ..... E21B 43/086
2018/0274312 A1* 9/2018 Zhou ..... E21B 43/08
2018/0340381 A1* 11/2018 Zhou ..... E21B 4/02
2019/0055801 A1* 2/2019 Hveding ..... E21B 4/18

FOREIGN PATENT DOCUMENTS

CA 2 585 498 C 10/2013
WO 2018/176057 A1 9/2018

OTHER PUBLICATIONS

Machine translation of Linkedin profile of Sanjiv Kumar (https://sa.linkedin.com/in/sanjiv-kumar-055640179) (Year: 2022).*

* cited by examiner

*Primary Examiner* — David Carroll
(74) *Attorney, Agent, or Firm* — Osha Bergman Watanabe & Burton LLP

(57) ABSTRACT

A system includes a flexi-string having a first lateral end, a second lateral end, and an outer diameter. The outer diameter defines an outer circumferential surface, and the outer diameter is smaller than an inner diameter of a casing shoe. The system further includes an anchor disposed on the outer circumferential surface of the first lateral end, where the anchor interacts with the casing shoe, or a last joint of casing, to hold the first lateral end of the flexi-string within the casing shoe. The system also has centralizers located between the first lateral end and the second lateral end of the flexi-string. The centralizers are configured to center the flexi-string within the casing shoe and the washout section. Finally, the system includes a roller guide for lowering the flexi-string inside the casing shoe and to a depth below the washout section of the well.

18 Claims, 4 Drawing Sheets

FLEXI-STRING FOR WASHOUT BELOW A CASING SHOE

BACKGROUND

In the petroleum industry, hydrocarbons are located in formations far below the Earth's surface. Wells are drilled into these formations to access and produce these hydrocarbons. Wells are made of wellbores drilled into the ground and supported by one or more casing strings that have been hung off at the surface and cemented in the wellbore. There are many completion schemes that are performed to help the well effectively produce the hydrocarbons. The completion schemes are dependent on the type of formation and the type of hydrocarbons being produced.

A common completion scheme, an open hole completion, requires that the portion of the wellbore drilled through the producing formation is left open, meaning that no casing or liner is placed across this section. Thus, hydrocarbons are free to flow directly from the formation into the wellbore to be produced to the surface. An open hole completion often leads to washout. As the hydrocarbons flow out of the formation, they often bring pieces of the formation, such as sand and rocks, to the surface. As more and more pieces of the formation are produced, the open hole becomes larger over time thus creating a washout section. The washout section may also be created during drilling due to excessive bit jet velocity and/or mechanical damage created by bottom hole assembly components.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The present invention presents, in accordance with one or more embodiments, systems and methods for centering a downhole tool within a washout section located below a casing shoe of a well. The system includes a flexi-string having a first lateral end, a second lateral end, and an outer diameter. The outer diameter defines an outer circumferential surface, and the outer diameter is smaller than an inner diameter of the casing shoe. The system further includes an anchor disposed on the outer circumferential surface of the first lateral end, where the anchor interacts with the casing shoe, or a last joint of casing, to hold the first lateral end of the flexi-string within the casing shoe. The system also has centralizers located between the first lateral end and the second lateral end of the flexi-string and disposed circumferentially around the outer circumferential surface of the flexi-string. The centralizers are configured to center the flexi-string within the casing shoe and the washout section. Finally, the system includes a roller guide, fixed to the second lateral end of the outer circumferential surface of the flexi-string, for lowering the flexi-string inside the casing shoe and to a depth below the washout section of the well.

In other embodiments, the method includes providing a flexi-string having a first lateral end, a second lateral end, a roller guide, and centralizers, anchoring the first lateral end of the flexi-string to the casing shoe, centering the flexi-string within the casing shoe and the washout section using the centralizers, moving the flexi-string in and out of the casing shoe using the roller guide, and preventing the downhole tool from contacting the washout section.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
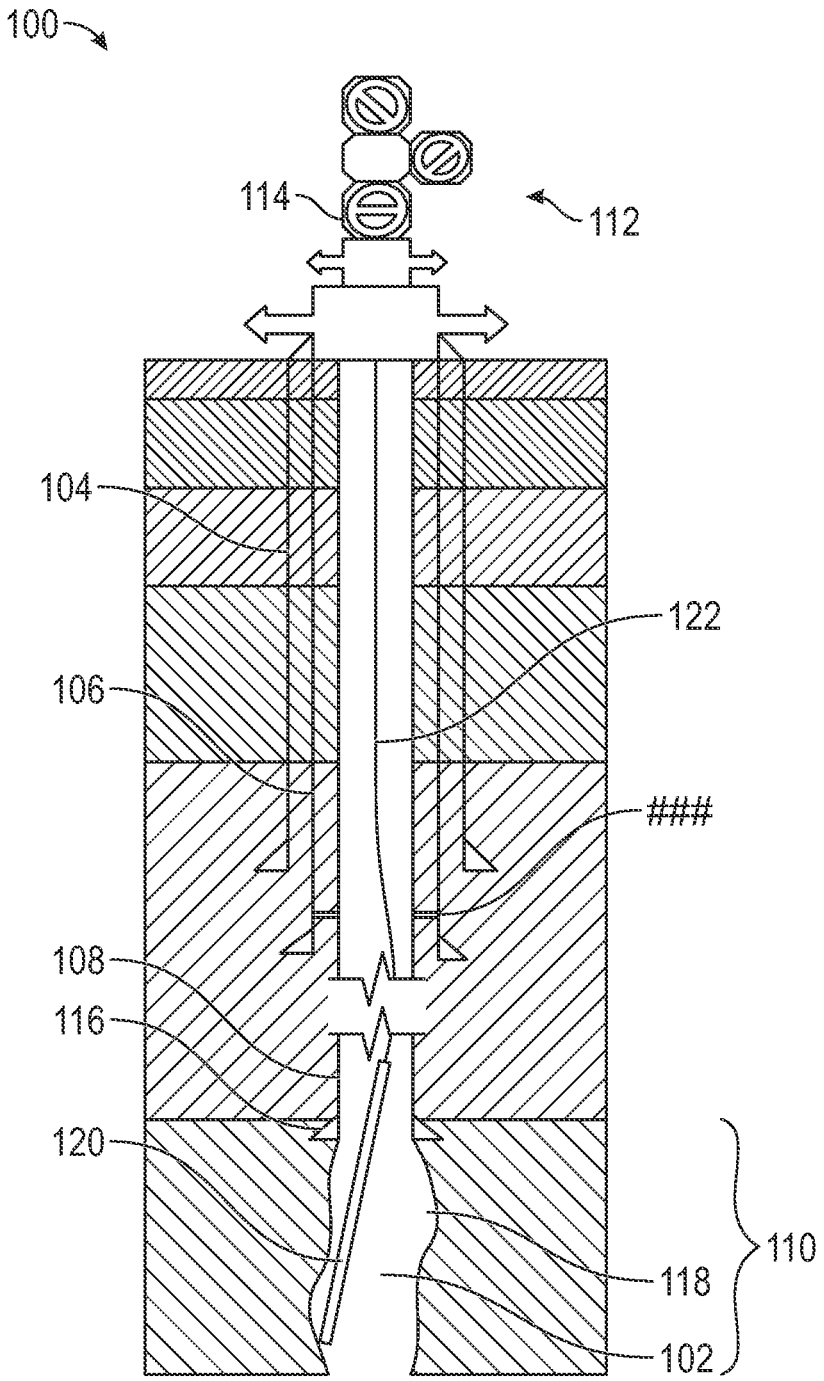
FIG. 1 shows an exemplary open hole completion scheme in accordance with one or more embodiments.

FIG. 1 shows a well (100) having an open hole (102) completion scheme in accordance with one or more embodiments. The well (100) depicted in FIG. 1 includes a first casing string (104), a second casing string (106), and a third casing string (108). The well (100) is completed with an open hole (102) section across a producing formation (110). The producing formation (110) may include fluids intended to be produced, such as hydrocarbons. The casing strings (104, 106, 108) extend from a surface location (112) to different depths downhole (i.e., depths within the surface of the Earth). The surface location (112) is a location on the surface of the Earth.

The shallow-most portion of each casing string (104, 106, 108) is housed in a wellhead (114). The wellhead (114) is located at the surface location (112). The wellhead (114) may be any type of wellhead known in the art and includes a series of spools and valves which allow access to the downhole portion of the well. The third casing string (108) has a casing shoe (116) defining the deepest point of the third casing string (108). The casing shoe (116) is on the opposite end of the third casing string (108) from the wellhead (114).

The casing shoe (116) may have had internal components such as a float collar that was used to prevent reverse flow of fluids into the third casing string (108) while the third casing string (108) was lowered into the well (100). The internal portion of the casing shoe (116) was drilled out prior to the open hole (102) section being drilled. As such, the casing shoe (116) shown in FIG. 1 is the outer remnants of the casing shoe (116) after the internal components had been drilled out to create the open hole (102). The well is shown with a washout section (118) in the open hole (102) located beneath the casing shoe (116) of the third casing string (108).

The washout section (118) may extend throughout the length of the open hole (102) or a portion of the open hole (102). The washout section (118) is a section of the open hole (102) that has been enlarged to a size larger than the size of the drill bit used to drill the open hole (102). The open hole (102) may have been enlarged due to production of fluids from the producing formation (110). The outer diameter of the drill bit used to drill the open hole (102) is smaller than the inner diameter of the casing shoe (116) and the third casing string (108) such that the drill bit may be run through the inside of the third casing string (108).

FIG. 1 also shows a tool (120) that has been run into the well (100) on a wireline (122). The tool (120) may be any type of tool shown in the art that would be run into a well (100), such as a rigless well intervention tool or a tractor. In other embodiments, the wireline (122) may be a slickline. The tool (120) is shown stuck in the washout section (118) of the open hole (102). When tools (120) are run into a washout section (118) of an open hole (102) they often get stuck beneath the casing shoe (116) due to the washout section (118) being larger than the casing shoe (116) and the third casing string (108).

Therefore, methods and systems that allow a tool (120) to be run into a washout section (118) of an open hole (102) without the tool (120) becoming stuck are beneficial. As such, embodiments disclosed herein present a flexi-string that may be run into the well (100) prior to the tool (120) being run into the well (100) to prevent the tool (120) from becoming stuck in the washout section (118) of the open hole (102). The flexi-string may be run into the well (100) riglessly and may be set within the casing shoe (116) of the deepest casing string (104, 106, 108). In other embodiments, the flexi-string may be set within a last joint of the deepest casing string, such as the third casing string (108). The last joint of the deepest casing string is the joint of casing located directly above (i.e., towards the surface location (112)) the casing shoe (116).

Figure 2:
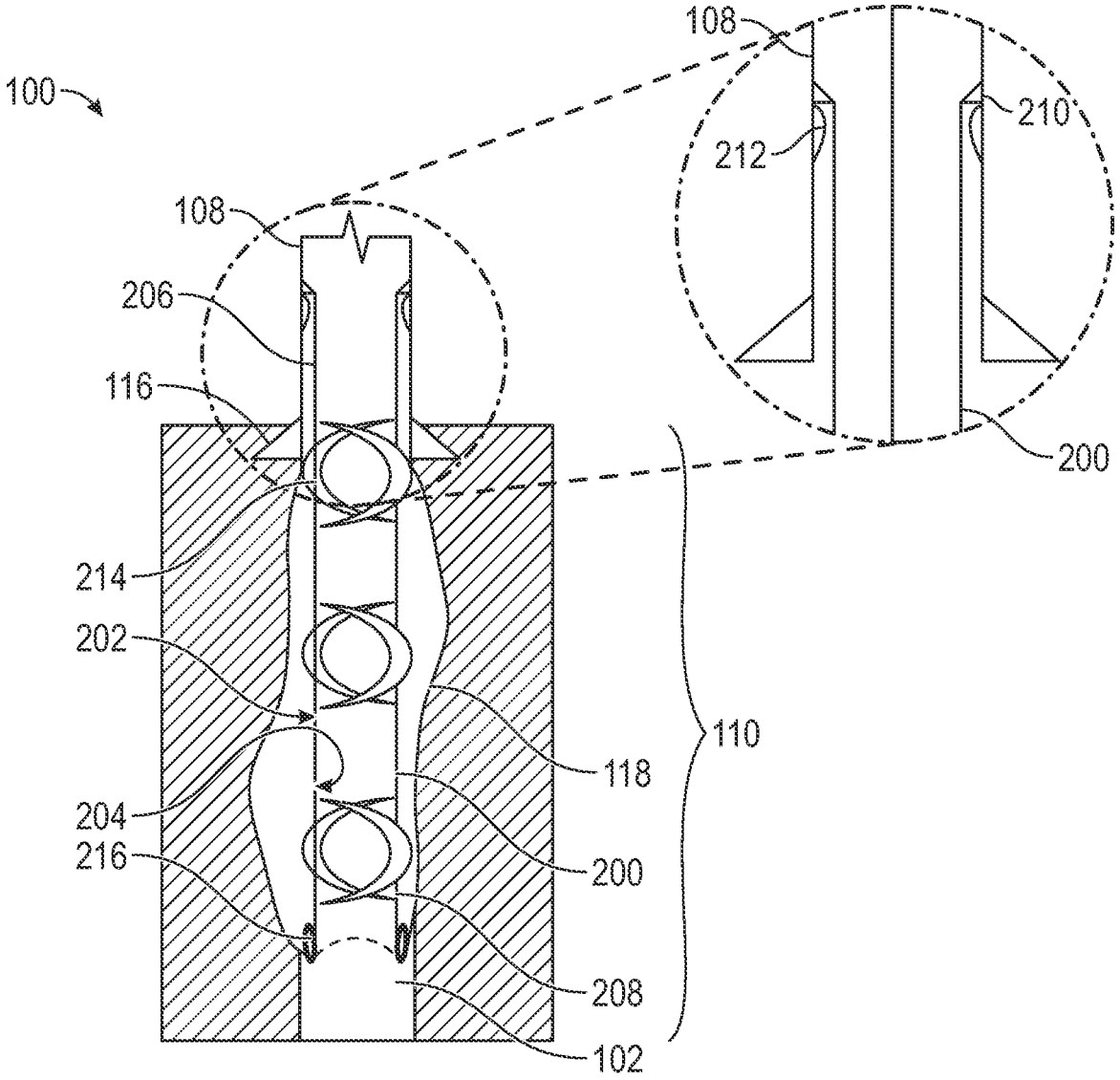
FIG. 2 shows a system in accordance with one or more embodiments.

FIG. 2 shows a system in accordance with one or more embodiments. More specifically, the well (100) as shown in FIG. 1, is shown with a flexi-string (200) deployed. Only a portion the well (100) from FIG. 1 is shown in FIG. 2. The portion shown is a portion of the third casing string (108), the casing shoe (116), and the open hole (102). The washout section (118) of the open hole (102) is also depicted. Components of FIG. 1 that are the same as or similar to components shown in FIG. 1 have not been redescribed for purposes of readability and have the same purposes as described above. Embodiments disclosed herein discuss deploying the flexi-string (200) in the well (100) as described in FIG. 1, however, any well having at least one casing string, a casing shoe, and an open hole section may be used to deploy the flexi-string (200) without departing from the scope of the disclosure herein.

The flexi-string (200) is formed in a tubular shape having an inner diameter and an outer diameter. The outer diameter of the flexi-string (200) is smaller than an inner diameter of the third casing string (108) and the casing shoe (116). The outer diameter defines an outer circumferential surface (202) of the flexi-string (200) and the inner diameter defines an inner circumferential surface (204) of the flexi-string (200). The flexi-string (200) may be made of any material known in the art, such as a polymeric material. A polymeric material may be used to lower the weight of the flexi-string (200). Further, the outer circumferential surface (202) of the flexi-string (200) may have a plurality of holes extending to the inner circumferential surface (204) of the flexi-string (200) to lower the weight of the flexi-string (200).

The flexi-string (200) may be lowered into the well (100) riglessly, thus a lower weight of the flexi-string (200) may be beneficial. Riglessly means that the flexi-string (200) may be lowered and set in the well (100) using wireline (122) or slickline rather than using a drilling or workover rig having a derrick. The flexi-string (200) has a first lateral end (206) and a second lateral end (208). When the flexi-string (200) is lowered in the well (100), the second lateral end (208) enters the well (100) first and the first lateral end (206) is the last portion of the flexi-string (200) to enter the well (100). The flexi-string (200) enters the well (100) through the wellhead (114) and through the inside of the third casing string (108).

The flexi-string (200) may be lowered into the well (100) using any means known in the art such as wireline (122), slickline, or drill pipe. The flexi-string (200) is lowered to a depth where the majority of the washout section (118) is covered by the flexi-string (200) and the first lateral end (206) is located within the casing shoe (116) of the third casing string (108). A plurality of flexi-strings (200) may be connected to each other at the surface location (112) to create a required length to cover the washout section (118) of the open hole (102). The flexi-strings (200) are connectable to each other by any means known in the art such as threading, welding, clamping, etc.

An anchor is disposed on the outer circumferential surface (202) of the first lateral end (206) of the flexi-string (200). The anchor interacts with the casing shoe (116), or a casing collar (212), to hold the first lateral end (206) of the flexi-string (200) within the casing shoe (116) or within the last joint of casing. The anchor may be a packer or a liner hanger. The anchor may also be a casing stop collar (210) as depicted in FIG. 2. The casing stop collar (210) catches on the casing collar (212) located in the casing shoe (116). The casing collar (212) of the casing shoe (116) is where two joints of the third casing string (108) have been threaded together. The casing collar (212) is slightly thicker than the rest of the third casing string (108), thus making the inner diameter of the third casing string (108) slightly smaller at the location of the casing collar (212).

The casing stop collar (210) is designed to catch on the casing collar (212), such that the flexi-string (200) is hung off of the casing collar (212). The casing stop collar (210) may initially be located flush within the flexi-string (200) (i.e., in the non-activated position) while the flexi-string (200) is being lowered into the well (100). Once the flexi-string (200) is at the correct depth (i.e., the first lateral end (206) being within the casing shoe (116) or within the last joint of casing), a signal, from the surface location (112), may be sent through the wireline (122) to actuate the casing stop collar (210). The signal may include activating a jarring mechanism. The jarring mechanism may break a pin located in the flexi-string (200) to actuate the casing stop collar (210). This actuation may jut the casing stop collar (210) out of the flexi-string (200) to catch on the casing collar (212). When the casing stop collar (210) is actuated, the casing stop collar (210) may jut out to the size of the inner diameter of the third casing string (108). A running tool, such as the commercially available GS pulling tool, may be used to retrieve the flexi-string (210).

A plurality of centralizers (214) are located between the first lateral end (206) and the second lateral end (208) of the flexi-string (200). The centralizers (214) are disposed circumferentially around the outer circumferential surface (202) of the flexi-string (200). The centralizers (214) may be any design known in the art. The centralizers (214) may be permanently fixed to the flexi-string (200), or the centralizers (214) may be snapped in place around the flexi-string (200) at the surface location (112) prior to being run in the well (100). Further, the centralizers (214) may also be made out of polymeric material.

Centralizers (214) have a larger diameter than the pipe which they are wrapped around. This helps the centralizers (214) keep the pipe centered in the hole through which the pipe is being run. As such, the centralizers (214), as depicted in FIG. 2, are configured to center the flexi-string (200) within the third casing string (108) as the flexi-string (200) is being run into the well (100). The centralizers (214) also help keep the flexi-string (200) centered when the flexi-string (200) is within the casing shoe (116) and the washout section (118) of the open hole (102). The centralizers (214) may be controlled from the surface location using an expandable system. The expandable system consists of using mechanical centralizers (214) that are able to move from a collapse position to an expanded position. As the flexi-string (200) and centralizers (214) are in the third casing string (108), the centralizers (214) are in the collapsed position due to the size of the inside of the third casing string (108). As the flexi-string (200) and centralizers (214) enter the washout section (118), the centralizers (214) are able to expand to fill up the space within the washout section (118) due to the change in inner diameter from the third casing string (108) to the open hole (102).

One or more roller guide(s) (216) are fixed on the outer circumferential surface (202) of the second lateral end (208) of the flexi-string (200). The roller guides (216) may be made of one or more wheels or similar devices that are free to rotate as the flexi-string (200) enters the well (100). The roller guides (216) aid in lowering and pulling the flexi-string into and out of the well (100) as the roller guides (216) may roll along the third casing string (108) or the open hole (102) as the flexi-string (200) is being lowered/pulled. The flexi-string (200) may be retrieved from the well (100) by running a retrieval device on the wireline (122), slickline, or drill pipe. The first lateral end (206) of the flexi-string (200) has an internal fishing neck. The retrieval device is designed to latch into the internal fishing neck of the flexi-string (200) to pull the flexi-string (200) out of the well (100). The retrieval device may be any type of fishing tool, such as the GS pulling tool. In other embodiments, the flexi-string (200) may be kept inside the well (100) for any subsequent intervention/workover jobs.

Figure 3:
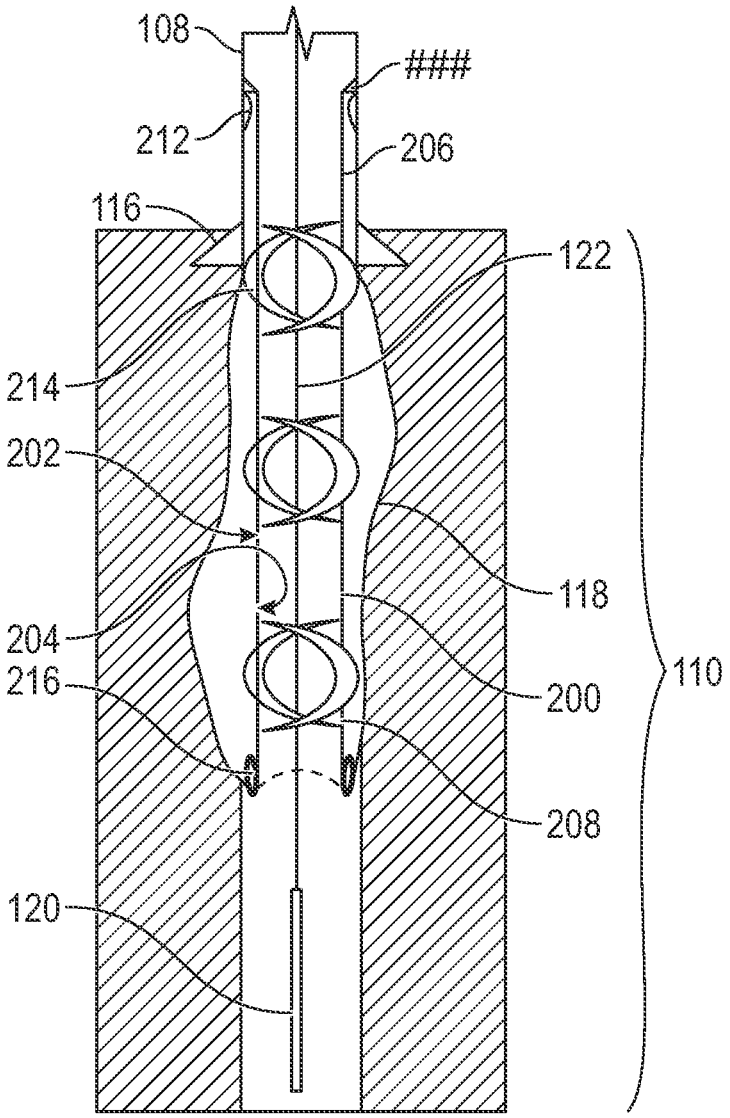
FIG. 3 shows a system in accordance with one or more embodiments.

FIG. 3 depicts a system with a tool (120) lowered into the well (100). Components of FIG. 3 that are the same as or similar to components shown in FIGS. 1 and 2 have not been redescribed for purposes of readability and have the same purpose as described above. The well (100) as described in FIG. 1 is shown with the flexi-string (200) as described in FIG. 2. The flexi-string (200) is shown having a casing stop collar (210), three centralizers (214), and two roller guides (216). The flexi-string (200) is set completely through the washout section (118) of the open hole (102) and the first lateral end (206) is set in the casing shoe (116) of the third casing string (108) on the casing collar (212). In other embodiments, the first lateral end (206) of the flexi-string (200) may be set within the last joint of casing of the third casing string (108).

As such, the tool (120) has been run through the third casing string (108), the casing shoe (116), the washout section (118), and into the non-washout section of the open hole (102). Because the flexi-string (200) covers the washout section (118), the tool (120) is able to be run in and out of the well without getting stuck. The tool (120) may be run on the same wireline (122) that lowered the flexi-string (200). After the tool (120) is pulled from the well (100), the same wireline (122) may be used to retrieve the flexi-string (200). The tool (120) may be used to aid in gathering data from the producing formation (110) or mechanically shutting off water production.

Figure 4:
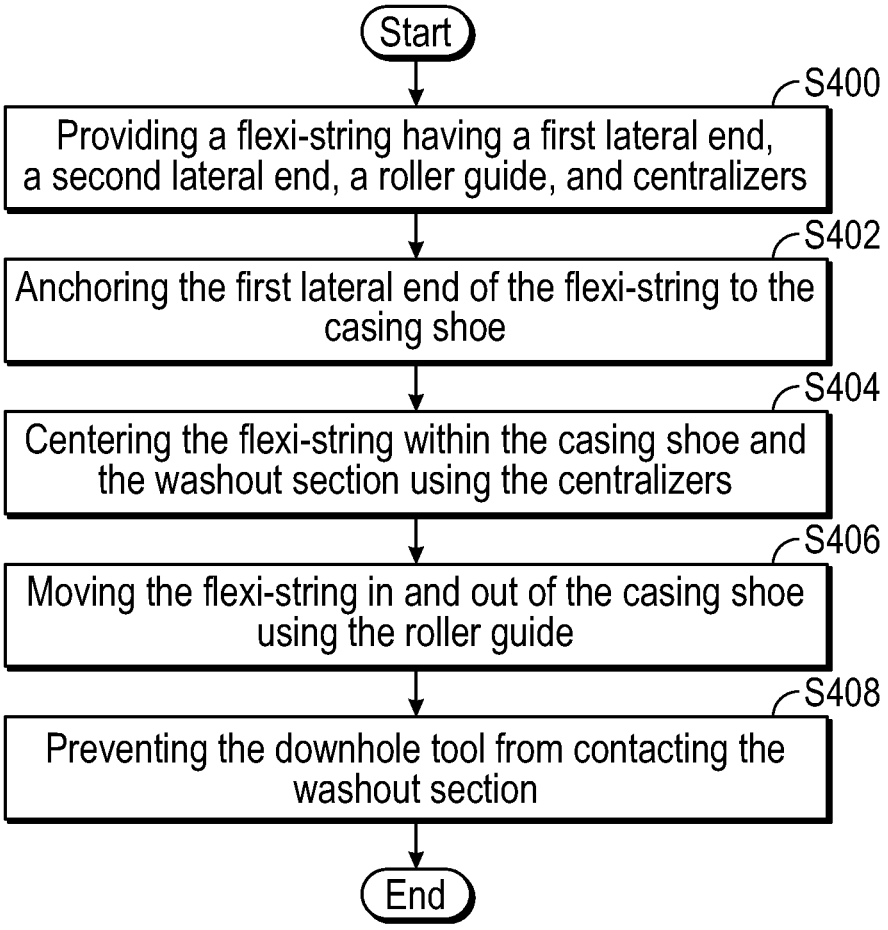
FIG. 4 shows a flowchart in accordance with one or more embodiments.

FIG. 4 depicts a flowchart in accordance with one or more embodiments. More specifically, FIG. 4 illustrates a method for centering a downhole tool (120) within a washout section (118) located below a casing shoe (116) of a well (100). Further, one or more blocks in FIG. 4 may be performed by one or more components as described in FIGS. 1-3. While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a flexi-string (200) having a first lateral end (206), a second lateral end (208), a roller guide (216), and centralizers (214) is provided (S400). The flexi-string (200) further includes an anchor that may be used to hold the flexi-string (200) within a casing string, such as the third casing string (108). The anchor is fixed to the outer circumferential surface (202) of the first lateral end (206), the roller guide (216) is fixed to the second lateral end (208) of the flexi-string (200), and the centralizers (214) are disposed around the outer circumferential surface (202) of the flexi-string (200).

The flexi-string (200) may be lowered into a well riglessly. The well may be a well similar to the well (100) described in FIG. 1. The flexi-string (200) may be lowered into the well (100) using a wireline (122) or a slickline. In other embodiments, the flexi-string (200) may be lowered into the well (100) using a drilling or workover rig with a derrick. The well has at least one casing string, such as the third casing string (108). The casing string has a casing shoe (116). The casing shoe (116) may have a casing collar (212). The flexi-string (200) may be lowered into the well (100) through a wellhead (114) and the casing string.

The first lateral end (206) of the flexi-string (200) is anchored to the casing shoe (116) (S402). The second lateral end (208) is located at a depth such that the flexi-string (200) covers the length of the washout section (118) of the open hole (102). The first lateral end (206) is anchored using the anchor. The anchor may be a casing stop collar (210) that hangs off of the casing collar (212) in the casing shoe (116). The flexi-string (200) is centered within the casing shoe (116) and the washout section (118) using the centralizers (214) (S404). Each centralizer (214) may be adjusted using an expandable system. The flexi-string (200) is moved in and out of the casing shoe (116) using the roller guide (216) (S406).

A downhole tool (120) may be lowered into the well (100) and into the flexi-string (200). The downhole tool (120) is prevented from contacting the washout section (118) (S408) due to the flexi-string (200) covering the washout section (118) of the open hole (102). The downhole tool (120) may enter a portion of the open hole (102) that is not covered by the flexi-string (200) and is not a washout section (118). The downhole tool (120) may be lowered into the well (100) using a wireline (122), a slickline, or dill pipe. The downhole tool (120) may be pulled from the well (100), and the wireline (122), slickline, or drill pipe may enter the well (100) to remove the flexi-string (200) from the well (100).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A system for a washout section located below a casing shoe of a well, the system comprising:

a tubular made of polymeric material having a first lateral end, a second lateral end, and an outer diameter, wherein the outer diameter defines an outer circumferential surface, and the outer diameter is smaller than an inner diameter of the casing shoe;

an anchor disposed on the outer circumferential surface of the first lateral end, wherein the anchor interacts with the casing shoe, or a last joint of casing, to hold the first lateral end of the tubular within the casing shoe;

centralizers located between the first lateral end and the second lateral end of the tubular and disposed circumferentially around the outer circumferential surface of the tubular, wherein the centralizers are configured to center the tubular within the casing shoe and the washout section; and a roller guide, fixed to the second lateral end of the outer circumferential surface of the tubular, for lowering the tubular inside the casing shoe and to a depth below the washout section of the well.

2. The system of claim 1, wherein the tubular is configured to be lowered into the well riglessly.

3. The system of claim 1, wherein the outer circumferential surface of the tubular has holes extending to an inner circumferential surface of the tubular to lower a weight of the tubular.

4. The system of claim 1, further comprising:

a plurality of tubulars, wherein each tubular is connectable with one another.

5. The system of claim 1, wherein the centralizers are made of a polymeric material.

6. The system of claim 1, wherein the roller guide is made of a polymeric material.

7. The system of claim 1, wherein the anchor further comprises a casing stop collar configured to catch on a casing collar of the casing shoe.

8. The system of claim 1, wherein each centralizer is adjusted in size using an expandable system.

9. The system of claim 8, wherein each centralizer changes from a collapsed position to an expanded position when each centralizer enters the washout section.

10. A method centering a downhole tool within a washout section located below a casing shoe of a well, the method comprising:

providing a tubular made of a polymeric material having a first lateral end, a second lateral end, a roller guide, and centralizers;

anchoring the first lateral end of the tubular to the casing shoe;

centering the tubular within the casing shoe and the washout section using the centralizers;

moving the tubular in and out of the casing shoe using the roller guide; and preventing the downhole tool from contacting the washout section.

11. The method of claim 10, further comprising:

lowering the tubular into the well riglessly.

12. The method of claim 10, wherein an outer circumferential surface of the tubular has holes extending to an inner circumferential surface of the tubular to lower a weight of the tubular.

13. The method of claim 10, wherein providing a tubular having a first lateral end, a second lateral end, a roller guide, and centralizers further comprises a plurality of tubulars, wherein each tubular is connectable with one another.

14. The method of claim 10, wherein the centralizers are made of a polymeric material.

15. The method of claim 10, wherein the roller guide is made of a polymeric material.

16. The method of claim 10, wherein anchoring the first lateral end of the tubular to the casing shoe further comprises a casing stop collar, fixed to the first lateral end of the tubular, catching on a casing collar of the casing shoe.

17. The method of claim 10, wherein each centralizer is adjusted in size using an expandable system.

18. The method of claim 17, wherein each centralizer changes from a collapsed position to an expanded position when each centralizer enters the washout section.

* * * * *